US005673723A

United States Patent [19]

Roediger

[11] Patent Number: 5,673,723

[45] Date of Patent: Oct. 7, 1997

[54] VACUUM SEWERAGE SYSTEM

[75] Inventor: Markus Roediger, Alzenau, Germany

[73] Assignee: Roediger Anlagenbau-GmbH, Hanau, Germany

[21] Appl. No.: 517,420

[22] Filed: Aug. 21, 1995

[30] Foreign Application Priority Data

Sep. 3, 1994 [DE] Germany ..... 44 31 486.8

[51] Int. Cl.[6] ..... F04F 3/00

[52] U.S. Cl. ..... 137/205; 137/236.1

[58] Field of Search ..... 137/205, 236.1

[56] References Cited

U.S. PATENT DOCUMENTS

| | | | |
|---|---|---|---|
| 4,155,851 | 5/1979 | Michael | 137/236.1 X |
| 4,179,371 | 12/1979 | Foreman et al. | 137/236.1 X |
| 5,083,885 | 1/1992 | Ushitdra et al. | 137/236.1 X |

OTHER PUBLICATIONS

ATV–"Gesondere Entwasserungsverfahren . . . A116", Sep. 1992.

Environmental Protective Agency Manual No. 625/1–91/024–Oct. 1991 (pp. 102–109).

*Primary Examiner*—Gerald A. Michalsky

*Attorney, Agent, or Firm*—Dennison, Meserole, Pollack & Scheiner

[57] ABSTRACT

The present invention concerns a vacuum sewerage system for collecting wastewater from a number of buildings comprising a vacuum sewer which is on one end connectable to a vacuum source and into which wastewater from the buildings can be aspirated via interphase valves. The vacuum sewer has a height profile comprising a sequence of low and high points, whereby wastewater can accumulate at the low points while the system is at rest. If air flows, the wastewater accumulations are pushed from the low points over the subsequent high points. The invention proposes to provide first and a second sections of the vacuum sewer with different height profiles. The height profiles are such that the maximum volume of the wastewater accumulations at the low points of height profile I is by preferably at least 3 times smaller than the maximum volume of the wastewater accumulations in height profile II.

18 Claims, 3 Drawing Sheets

VACUUM SEWERAGE SYSTEM

BACKGROUND OF THE INVENTION

The invention concerns a vacuum sewerage system, particularly for housing areas, comprising a vacuum sewer to which at one end at least one vacuum source is connectable and wastewater drains are connectable via interface valves for batchwise aspiration of wastewater and air, whereby the vacuum sewer is laid in a height profile with low points allowing for accumulation of wastewater and high points.

Such systems are used for instance where housing areas have a low density, where the slope is insufficient for conventional gravity sewerage systems, where the wastewater flow varies seasonally, e.g. at holiday resorts, or where water protection areas have to be crossed. In addition, its use has been proven advantageous where the ground conditions are poor, e.g. in areas with high ground water levels.

Vacuum sewerage systems are generally used as separate systems, i.e. for the conveyance of wastewater without rain water. Therefore, the daily amount of wastewater is approximately equal to the daily water consumption.

The wastewater usually flows by gravity from the connected buildings into collecting sumps. The capacity of these sumps is large enough to serve as emergency storage tank in case of vacuum system's failure. These sumps are connected with the vacuum sewer via normally closed interface valves. As soon as a certain batch volume of wastewater has accumulated in a sump, a sensor activates a controller which opens the interface for a certain time period. The batch volume of wastewater and a larger volume of air is aspirated via the open interface into the vacuum sewer. The air can be aspirated simultaneously with and/or subsequent to the wastewater. Wastewater and air flow along the vacuum sewer towards a vacuum vessel of a vacuum station. A certain vacuum level is maintained in the vacuum vessel by at least one vacuum source, e.g. a vacuum pump. Controlled by the wastewater level in this vessel, the wastewater is forwarded from the vessel to e.g. a wastewater treatment plant. Forwarding pumps are usually provided for this purpose.

Vacuum sewers are laid according to a certain height profile with systematically arranged high and low points. The wastewater accumulates at the low points when no air flows, when the system is at rest. When an upstream interface valve is opened, air streams along the vacuum sewer and pushes the accumulated wastewater over the subsequent high point. The height profile has to guarantee a good momentum transfer from the air to the wastewater. The momentum serves for forwarding the wastewater along the vacuum sewer with sufficient velocity so that sediments are whirled up by highly turbulent wastewater flows. A periodic velocity of at least 0.7 m/s is required. The air overcomes the wastewater in the downsloped sections of the vacuum sewer and accelerates the wastewater which has accumulated at the subsequent low point.

Uphill sections of the vacuum sewer are built such that the level differences between high points and subsequent low points are smaller than those between low points and subsequent high points.

A pressure gradient is produced along the vacuum sewer, firstly hydrostatically due to water seals at the low points and secondly hydrodynamically due to acceleration and friction forces. The overall length and overall geodetic level difference of vacuum sewers is limited by the available pressure difference between the upstream ends of the sewer and the vacuum vessel. This pressure difference is usually in the order of 40 kPa. The greater the ratio of the aspirated volumes of air (at standard temperature and pressure, s.t.p.) and wastewater—the so called air/sewage-ratio—, the more energy is available for transporting the wastewater. On the other hand, a high air/sewage-ratio requires high capacities of the vacuum generators in the vacuum station, high energy consumptions and large diameter vacuum sewers. The design of vacuum sewer systems should keep the pressure losses low. Both, hydrostatic losses due to water seals as well as hydrodynamic losses due to acceleration and friction, have to be taken into account.

According to the state of the art, two generally different types of height profiles are in use.

Most of the vacuum sewerage systems in Germany have a height profile with high and low points arranged at distances of ca. 10 to 20 m. The up- and downslopes are in the order of 1%, the level difference between high and low points in level ground is approximately 10 to 30 cm. Batch volumes of around 10 liters sewage are aspirated via interface valves with diameters of ca. 50 min. This height profile is the basis of the work sheet A 116 of the ATV (Abwassertechnische Vereinigung).

During the design of a vacuum sewerage system, the worst case has to taken into consideration, i.e. when the vacuum sewer is filled with wastewater to its maximum. This flooding can occur when only wastewater and no air has been aspirated, e.g. after a break down of the system when large volumes of wastewater have been collected in the sumps. In this worst case, wastewater accumulations at the low points extend upstream to a point whose invert level is approximately equal to the crown level of the low point. They extend downstream to the subsequent high point.

As an example, a pipeline in level ground shall have an internal diameter of 100 mm, distances of 15 m between high points and subsequent low points and of 10 m between low points and subsequent high points and a level difference between the low and high points of 15 cm. The maximum volume of wastewater accumulating at the low point is approximately 90 liters which is equal to a completely filled pipe length of nearly 12 m. The maximum hydrostatic height difference is equal to the level difference between the summit level at the low point and the invert level at the high point (15 cm−10 cm=5 cm) which is equivalent to a pressure difference of 0.5 kPa. An available overall pressure difference of 40 kPa is in the worst case sufficient for the arrangement of 40:0.5=80 subsequent low points. The maximum length of the vacuum sewer is 80* (15+10)m=2 km. If there is a geodetic height difference to overcome, the maximum length is shorter.

The energy needed to accelerate this wastewater volume of 90 liters to a velocity of 1 m/s and to lift it by 15 cm is ca. 180 J. This energy is equivalent to the isothermic expansion energy of 360 liters and 250 s.t.p.-liters of air at a pressure difference between 70 and 69.5 kPa.

However, the vacuum sewerage systems of the type mainly used in Germany have usually air/sewage-ratios of less than 15:1 and batch volumes of wastewater of around 10 liters. Therefore, the batch volumes of air are normally less than 150 s.t.p.-liters and usually in the order of 30 to 100 s.t.p.-liters. When a system is flooded, the velocities are too slow to whirl up sludge deposits. In addition the slow velocities hinder a fast recovery of a flooded system. The recovery time is particularly long when interface valves are used whose air/sewage-ratios are very low or even zero if the collection sumps are full of wastewater.

This is the reason why the working sheet A 116 of the ATV specifies a maximum vacuum sewer length of 2 km, a maximum pipe diameter of 150 mm and a maximum of 500 inhabitants connected per vacuum sewer main.

The other height profile is mainly used in the US and is described in manual No. 625/1-91/024 of the Environmental Protection Agency. It is a saw moth shaped profile. Between the high points and the low points, the vacuum sewer has a long downslope of at least 0.2%. Between the low points and the high points, the upslope is usually 100% and the height difference is usually 30 to 60 cm. The maximum volume of wastewater accumulations in a vacuum sewer with 100 mm internal diameter is nearly 200 liters which is equivalent to 25 m completely filled pipe.

Batch volumes of ca. 40 liters are aspirated through interface valves with diameters of ca. 75 min. The energy needed to accelerate the wastewater accumulations of 200 liters to 1 m/s and to lift it over the next high point is ca. 700 J. An air flow of ca. 345 liters or 240 s.t.p.-liters with a pressure difference between 70 and 68 kPa would be necessary. This requires an air/sewage- ratio of 6:1 which is not always present. In addition, large batch volumes should be avoided in order to reduce the danger of septicity and odor emission.

SUMMARY OF THE INVENTION

The problem to be solved by the present invention is to improve vacuum sewerage systems as previously described in respect of reliability, economy and energy efficiency. Flooded systems shall be able to recover rapidly. The maximum lengths of vacuum sewers and the maximum number of inhabitants connectable per sewer main shall be well above 2 km and 500 respectively. Permanent sludge deposits in the vacuum sewers shall be prevented, even when the batch volumes and interface valves are small or the air/sewage-ratio is low.

The present invention solves the problem by proposing to provide vacuum sewers with first and second sections having different height profiles, i.e. different geometric arrangements of low and high points, whereby the maximum volume of wastewater accumulations at the low points in the vacuum sewer's first section at no-flow condition is smaller than the maximum volume of those in the vacuum sewer's second section.

Particularly, the maximum volume of wastewater accumulations in the second section is at least approximately 3 times larger than the maximum volume in the first section.

Preferably, the height profile in the first section is such that the wastewater accumulations at the low points extend maximally by 1 to 3 m upstream from the low points, whereas the maximum wastewater accumulations at the low points of the second section can extend by more than 5 m upstream from the low points. The height profile II is according to the known saw-tooth profile as described previously.

The invention is based on the idea that it makes a general difference whether batchwise or continuous flow occurs in vacuum sewers. Batchwise flow occurs even at peak flow at the extremities of the vacuum sewers where only a limited number of inhabitants are connected. There are pauses between the opening cycles of the interface valves. Continuous flow occurs at least at peak flow where a sufficiently large number of inhabitants is connected upstream or where air is aspirated periodically over an extended period of time, e.g. where an air admission valve is provided upstream and opened periodically.

The first sections of the vacuum sewers are located at the upstream ends of the vacuum sewers, whereas the second sections are connectable to the vacuum source. In the first sections, the wastewater is forwarded batchwise from the low points over the high points, whereas in the second section air and wastewater flow more or less continuously at least during peak flow.

With other words, the invention proposes to provide different height profiles:

The first height profile is used in first upstream sections, near the upstream ends of the vacuum sewers; in the first sections where air and wastewater normally flow batchwise, the height profile is such that only small maximum volumes of wastewater can accumulate at the low points when the system is at rest (i.e. no-flow condition); the second height profile is used in second sections, downstream from the first sections in the direction to the vacuum station, where wastewater and air flow more or less continuous at least during peak flow; this height profile is such that large maximum volumes of wastewater can accumulate at the low points when the system is at rest.

For a batchwise flow it is neccessary to push the wastewater accumulations at the low points as plugs over the next high points. The velocities have to be sufficient to prevent permanent sludge deposits. The maximum volumes of the wastewater accumulations should be small enough so that even small batch volumes of air are sufficient to create high velocities. These small volumes shall fill the low points up to or close to the crown of the pipeline in order to form water seals or to reduce the free cross sectional areas for the air flow. This is necessary for a good momentum transfer from the air stream to the accumulated wastewater. Strong reductions of the free cross sectional areas create high air velocities immediately overneath the wastewater surface; waves are produced which block the air passage and improve the momentum transfer. The air flow aspirated per valve opening cycle shall be sufficient for transfering as much energy to the wastewater accumulations as required for sufficient acceleration and lifting when the air is expanded by the hydrostatic pressure difference being present when the low points are water sealed.

In the second height profile, continuous flow occurs at least during peak flow or while an air admittance valve is opened upstream. At the low points, where the free cross sectional area for the air flow is reduced, waves with sufficient velocities are created which whirl up sludge deposits. The total volume of accumulated wastewater needs not be pushed batchwise over the next high point, it is sufficient when a sequence of waves are pushed over. The velocity of the continuous air flow shall be higher than the velocity of the waves produced. An air velocity of at least 1 m/s is sufficient.

The wastewater accumulations at the low points of section II can be very long and can extend far upstream from the low points. In a pipe with an internal diameter of 100 mm, a downslope of 0.2% between a high point and a subsequent low point and a lift height of 100 mm or more, the wastewater accumulation can be 50 m long and have a volume of ca. 200 liters. A sufficient batchwise acceleration of this total volume is not possible with small air batches. Small air batches can only produce small waves and cannot prevent sludge deposits.

The length of a vacuum sewer system according to the present invention is not limited to 2 km, as required by the previously mentioned A 116. In the first section with height profile I, the hydrostatic losses are relatively high and usually prevalent over the hydrostatic losses. In the second section with height profile II, however, the hydrostatic losses are relatively low, even when the lift height H exceeds the internal pipe diameter D. Assuming H−D=0,2 m, the hydrodynamic loss in height profile II is smaller than the hydrostatic loss, as long as the air/sewage ratio exceeds a value of approximately 2:1 which is usually the case. The limitations of a maximum of 500 connected inhabitants and of maximum pipe diameters of 150 mm are applicable only for the first section, but not for the second section with height profile II. Sludge deposits are prevented due to velocities exceeding 0.7 m/s in section I every time an upstream interface valve cycles and in section II at least during peak flow or while an air admission valve is open.

Preferably, the maximum volume of wastewater accumulated at the low points of section I is between 5 and 50 liters. For sufficient accelerating and lifting of a batch of 30 liters at no flow condition, and the maximum volume of wastewater accumulated at the low points of section II is between 150 and 5000 leters at no flow condition in a pipe with an internal diameter of 100 mm over a height of 30 cm, an energy of 105 J is required. An air batch of ca. 50 s.t.p. liters is required when the air is expanded from 70 to 68 kPa. Assuming a batch volume of aspirated wastewater of 10 liters, an air/sewage-ratio of between 0.8:1 and 8:1 is required respectively.

According to a further inventive proposal, the geometric shape in section I is such that the low point is located in a pipe section shaped like an U with two legs of different lengths, whereby the longer leg connects the low point with the downstream high point and whereby the shorter leg connects the low point with the upstream vacuum sewer. Preferably, both legs have a slope of at least 3% and the vacuum sewer has a slope of at least 0.2% between the high point and the short leg, whereby the invert of the transition point to the short leg is at the same level as the crown of the low point. If the height difference between the low and high points is 30 cm and the pipe diameter is 10 cm, the length of the 0.2% downslope is 100 m. The upstream short leg of the U-shaped low point fills by 10 cm. If its average downslope is 10%, its length is 1 m. The downstream long leg connecting the low point with the subsequent high point rises by 30 cm. If it has an average upslope of 10% its length is 3 m. If the wastewater accumulation at the low point has reached its maximum volume, the long leg is nearly completely filled and the short leg is half filled. The maximum volume is approximately 27 liters. Naturally, other shapes with the required volumes and a variety of different slopes can be used. In practice, curved pipes may be used to form the low and high points. These curved pipes have two inflection points, one is located in the upstream and the other is located in the downstream leg.

The invention further proposes to provide the height profile II in section II in such a way that the vacuum sewer in level ground has a downslope of at least 0.2% between the high points and subsequent low points and an upslope of at least 3% between the low points and the subsequent high points. The lift heights are preferably equal to between one and two times the internal pipe diameter. Preferably, the downslope is as small as 0.2% and the lift height is between 10 cm and 30 cm. If the lift height is 20 cm, the length of the 0.2% downslope section is 100 m. If the low and high points are formed by bending plastic pipes with a ratio of the bending radius to the diameter of 50:1, the length of a lift is nearly 3 m and its average upslope is 6.7%.

The lifts in section II are S-shaped with only one inflection point between the low and high point. Naturally, the lift can also be built of angled instead of curved pipes.

Neither the maximum hydrostatic losses nor the hydrodynamic losses at peak flow (which should be around 1 m/s air velocity in the empty pipe) should exceed the available pressure. As long as the hydrostatic pressure losses do not exceed the hydrodynamic pressure losses at peak flow, the lift heights may exceed the internal pipe diameters.

Height profile I is preferably used where the probability that at least one of the upstream interface valves is open at peak flow is less than 90%. If this probability were higher, the flow would be nearly continuous and height profile II should be prefered due to its lower pressure losses. Height profile II is preferably used where this probability is above 50%. Where this probability is between 50% and 90%, both height profiles can be used.

Alternatively, height profile I is preferably used where the maximum hourly peak flow is below 1 l/s and height profile II is used preferably where the maximum hourly peak flow is above 0.5 l/s. This is e.g. equivalent to the above referred probabilities if 10 l of wastewater and 50 to 100 l of air are aspirated during an opening period of 10 s through an interface valve with a diameter of 50 mm.

Alternatively, height profile I is preferably used where less than 125 inhabitants are connected upstream and height profile II is preferably used where more than 60 inhabitants are connected upstream. Assuming an hourly peak flow of 0.008 l/s/P, this is equivalent to a flow of 1 l/s or 0.5 l/s respectively.

Different figures for the wastewater flow and for the number of connected inhabitants result if the size of the interphase valve, the air/sewage-ratio or the peak flow is different.

Preferably, the internal diameters of the vacuum sewers of section I with height profile I have a maximum of 125 min. Assuming a batch flow of 10 l wastewater and of 80 s.p.t. 1 air within a time of 10 s and a pressure of 70 kPa, the batch velocity of the wastewater and air in this sewer size is 1 m/s. The minimum internal diameter of section II is preferably 80 mm. Assuming a peak wastewater flow of 0.5 l/s, an air/sewage-ratio of 4:1 and a pressure of 60 kPa, this is equivalent to a velocity of above 0.7 m/s.

Further, the level difference between a low point and a subsequent high point in the first section is preferably approximately 1 to 5 times the internal diameter of the vacuum sewer in this region, and the level difference between a low point and subsequent high point in the second section is preferably approximately 0.6 to 3 times the internal diameter of the vacuum sewer in this region.

According to a further proposal of the invention, air admittance valves are provided preferably at the transition between height profile I and II or downstream of increases of the vacuum sewer's diameter. These air admittance valves can be opened by a time controller in order to flush the downstream vacuum sewer periodically with high air flow velocities of above 0.7 m/s. This allows for using height profile II also where sufficient flow velocities at least during peak flow are not guaranteed, e.g. where the wastewater flow varies seasonally (e.g. in holiday resorts) or where long sewers with few connected inhabitants are to be provided. In other words: Air admittance valves allow for use of height profile II where the wastewater flow could be low.

Preferably, vacuum sewer's pipe sections including a low point and a subsequent high point are made of a thermoformed plastic pipe. Due to the fact that bending of plastic pipes is limited, short distances between subsequent low and high points usually require connections of bends or elbows. By use of thermoformed pipe segments it is possible to avoid such connections and to reduce costs and the danger of leakage. Thermoforming is usually performed by bending the pipe while it is submersed in a hot liquid. In order to avoid buckling during the thermoforming, the pipe is filled with sand or internal overpressure is applied.

Further details, advantages and characteristics of the invention not only ensue from the claims, the characteristics taken therefrom —individually and/or in combination—, but also from the following description of preferred exemplary embodiments to be found in the drawings.

BRIEF DESCRIPTION OF THE DRAWINGS

In the sections (10) and (100) of the vacuum sewer (28) of a vacuum sewerage system, the wastewater is transported in the direction of the arrow. FIG. 1 shows a first section (10) with height profile I which is located near the extremities of the vacuum sewer. FIG. 2 shows a second section (100) with height profile II which is located downstream of the first section (10) towards a vacuum source or vacuum station. Each section (10) and (100) includes a low point (12) or (112) and a high point (14) or (114).

FIGS. 1 and 2 show an accumulation (16) or (116) of wastewater at the low point (12) or (112) while the system is at rest. High points (14) and (114) are located downstream of the low points (12) and (112).

Figure 1:
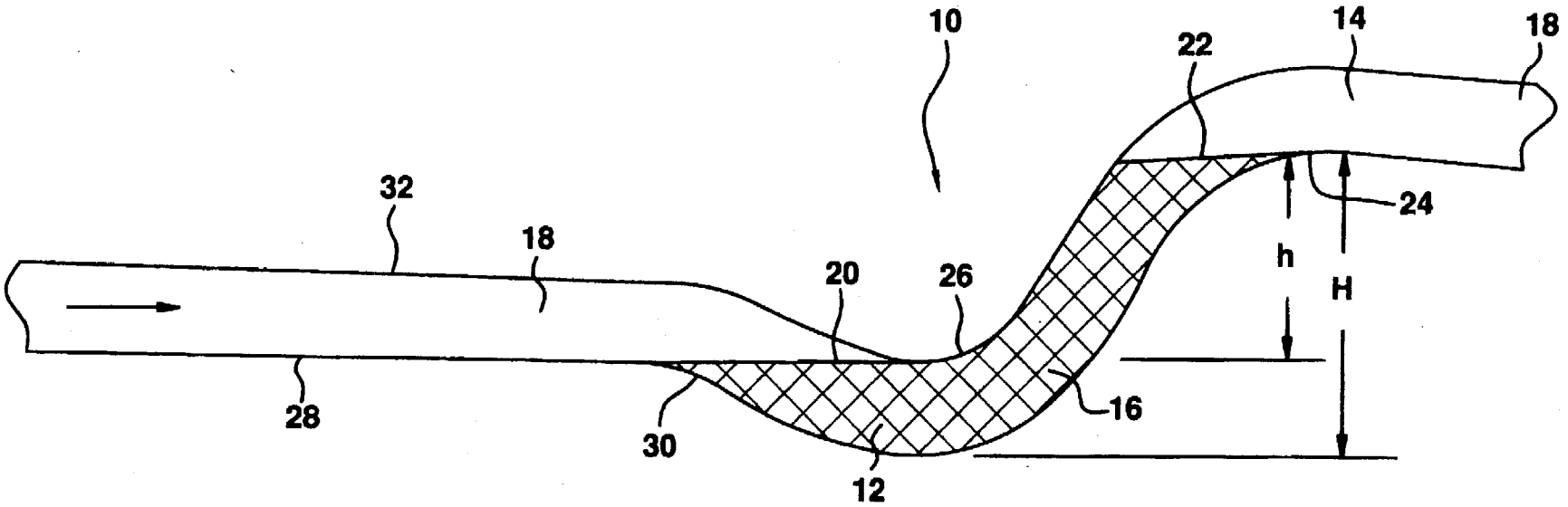
FIG. 1 shows a principle scheme of a low and subsequent high point in a first section of a vacuum sewer with height profile I.

While the wastewater accumulation (16) at the low point (12) of height profile I (10) forms a water seal which blocks the passage of air, a small cross section (104) remains above the water surface (102) at the low point (112) of height profile II (100). Air can flow through this cross section (104). While there is a hydrostatic pressure loss and a level difference of the water surfaces (20) and (22) at the up- and downstream sides of the low point (12) in height profile I (10), there is no hydrostatic pressure loss and no level difference in height profile II (100). The maximum hydrostatic pressure loss of height profile I (10) is equivalent to the maximum level difference of the water surfaces (20) and (22) which is equal to the difference h between the invert level (24) at the high point (14) and the crown level (26) at the low point (12).

Figure 2:
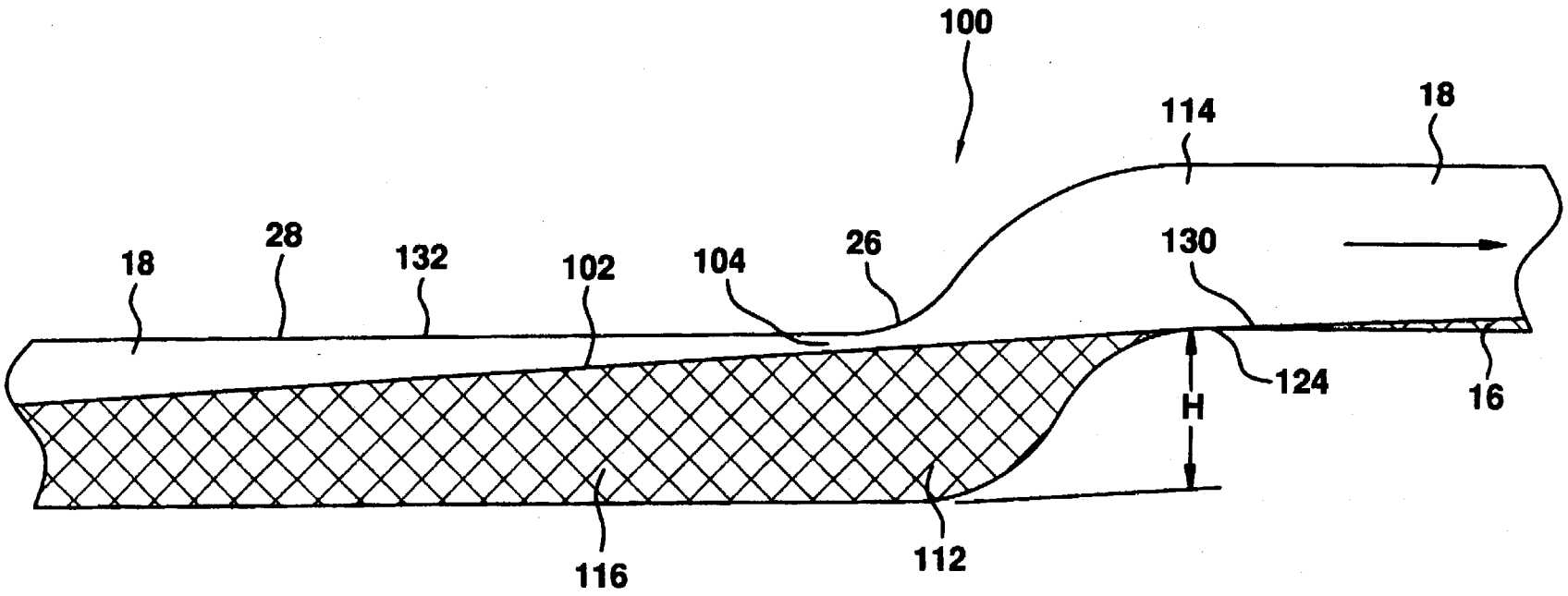
FIG. 2 shows a principle scheme of a low and subsequent high point in a second section of a vacuum sewer with height profile II.

In the height profile II, shown in FIG. 2, this level difference is negative and there is no hydrostatic pressure difference.

It is emphasized, however, that the lift height in height profile II can be larger than the internal Diameter. If the difference H of the invert level (124) of the high point (114) and of the invert level at the low point (112) is raised to a value above the internal pipe diameter D, there could be a hydrostatic pressure loss in height profile II (100) too. In both height profiles (10) and (100), the maximum hydrostatic pressure loss is h=H−D. The maximum pressure losses are attained when the water surfaces (22) and (102) reach the invert levels (24) and (124) at the high points (14) and (114). Then, the volumes of the wastewater accumulations (16) and (116) reach their maximums. Under normal circumstances, overflow over the high points (14) and (114) prevents the water surface levels (22) and (102) from rising further.

When the system is at rest, i.e. when neither air nor wastewater flows through the vacuum sewer (28), there is a pressure gradient along the vacuum sewer (28), whereby the pressure decreases in the direction of the vacuum station at every water seal by its hydrostatic pressure difference. Usually, the hydrostatic pressure differences are lower than their maximum values h=H−D because the volumes of the water accumulations (16) and (116) do not reach their maximums. During the design of a system, however, the maximum hydrostatic pressure differences h should be taken into account, the sum of which should be smaller than the available pressure difference between the extremities of the vacuum sewers and the vacuum station. This available pressure difference has usually a value of around 40 kPa.

When the system is at rest, the maximum level of the water surface (20) can be only a little bit higher than the crown level (26) at the low points (12). A further rise of the level would compress the air volume (18) entrapped between the low point (12) and the preceeding high point which is not shown in FIG. 1. The pressure difference is, however, limited to the level difference of the water surfaces (22) and (20) which has a maximum value h.

In order to keep the maximum volume of the water accumulation (16) in height profile I (10) small, the vacuum sewer (28) has a steep downslope immediately in front of the low point (12). The water accumulation (16) can maximally extend until point (30) upstream from the low point (12) and point (30) is approximately at the same level as the crown level (26) at the low point (12). The distance between the points (30) and (12) is the smaller, the steeper the vacuum sewer (28) declines towards the low point (12). The smaller the volume of the water accumulation (16), the less energy is needed for accelerating this water accumulation (16).

In level ground, a section (32) of the vacuum sewer (28) declines gradually between a preceeding high point and the point (30) by a level difference h=H−D. When the minimum slope is 0.2%, the maximum length of this section (32) is 500 * h. Assuming a value h=10 cm, which is equivalent to a maximum hydrostatic pressure loss of p=1 kPa, the maximum length is 50 m. If one neglects the relatively short distance between the points (30) and (14), the maximum total length of the vacuum sewer (28) in level ground is L=500 * h * P/p whereby P is the available pressure difference in the system. If P is 40 kPa, the maximum total length L is limited to 2 km.

The length of the vacuum sewer's first section with height profile I (10) has to be significantly shorter than 2 km if the total length of the vacuum sewer is to exceed 2 km. Between this first section with height profile I (10) and the vacuum station, a second section with height profile II (100) is provided. The hydrostatic pressure losses in height profile II (100) are smaller than those in height profile I (10). They are eqivalent to h=H−D and zero if H<=D as shown in FIG. 2. Particularly, where the ground inclines, the lift height H will be greater than D.

In height profile II (100), the incline between low point (112) and high point (114) is preferably short and steep. The decline between high point (114) and the subsequent low point is gentle and long. If the slope is 0.2%, the maximum length of the declining section is 500 * H. Assuming lift heights H=20 cm and an internal pipe diameter D=15 cm, the length of this section in level ground is 100 m and the static pressure loss of a lift is 0.5 kPa.

The water accumulation (116) in height profile II (100) extends maximally to point (130) which has a level equal to the minimum of the invert level of high point (114) and of the crown level of low point (112). Point (130) is identical with high point (114) if H<=D, as shown in FIG. 2. The distance between point (130) and the low point (112) is the minimum of 500 * H and 500 * D.

If H=D, the points (130) and (114) fall together and the vacuum sewer is maximally half filled with wastewater. Assuming a distance between subsequent lifts of 100 m and an internal pipe diameter of 150 mm, the maximum volume of a wastewater accumulation (116) is approximately 880 liters.

Assuming a vacuum sewer in level ground with a total length of 4 km, with a 1 km long first section with height profile I (10) and a 3 km long second section with height profile II (100), the maximum hydrostatic pressure losses of the first and second section are 20 kPa and 15 kPa respectively. The maximum total hydrostatic loss is 35 kPa and smaller than the available pressure difference of usually 40 kPa.

Figure 3:
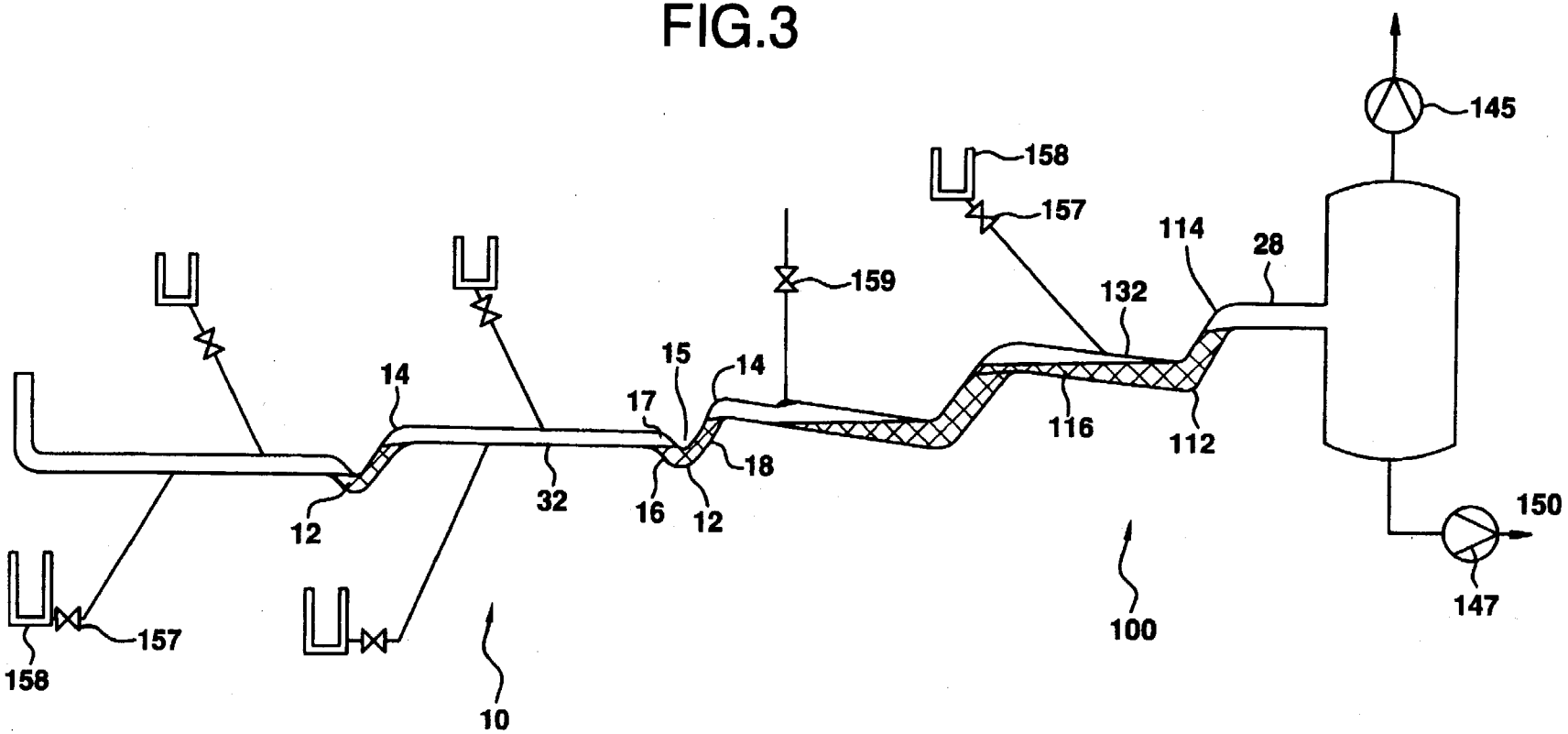
FIG. 3 is a schematic representation of an overall vacuum sewerage system including sections with profiles I and II.

FIG. 3 shows the overall vacuum sewerage system including sections 10 and 100. The system includes a vacuum vessel 140 connected to section 100 of the system, with a vacuum being maintained in vessel 140 by a vacuum pump 145. Wastewater flowing into vessel 140 is forwarded by a pump 147 in the direction 150 of a wastewater treatment plant.

Wastewater. which is collected in sumps 158 is admitted to the sewer by interphase valves 157. An air admission valve 157 provided at the transition between first section 10 and second section 100, or at an enlargement in the vacuum sewer's cross-sectional area, periodically produces flow velocities which are sufficient to whirl sedimentation.

I claim:

1. Vacuum sewerage system for wastewater collection comprising a vacuum sewer including means for connecting a vacuum source at a downstream end thereof, and means for connecting wastewater drains via interface valves for batchwise aspiration of wastewater and air, said vacuum sewer comprising first and second sections having different height profiles, each of said first and second sections having a high point and a low point at which accumulations of wastewater can form, said second section being arranged between said first section and said means for connecting a vacuum source, the low point of said first section being U-shaped and having an upstream leg and a downstream leg extending therefrom, the downstream leg having an upslope and connecting the low point to the high point of the first section and the upstream leg having a downslope and connecting the low point of the first section to a preceding upstream high point of the first section by way of a portion having a downslope which is smaller than the upslope of said downstream leg of the first section, said second section comprising at least one saw-tooth shaped lift connecting the low point of the second section to the high point of the second section downstream thereof, and a substantially straight portion connecting the low point of the second section to an upstream high point, wherein the low points of the first section and second section permit accumulations of water of maximum lengths such that the maximum length of water accumulation at the low point of the first section is smaller than the maximum length of water accumulation at the low point of the second section.

2. Vacuum sewerage system according to claim 1, wherein, the maximum volume of the wastewater accumulations in the region of the low points of the second section is at least aproximately three times larger than the volume of the accumulations in the region of the low points of the first section.

3. Vacuum sewerage system according to claim 1, wherein the first section is built with such a shape so that the maximum wastewater accumulation at no-flow condition extends approximately 1 to 3 meters upstream from the low point of the first section.

4. Vacuum sewerage system according to claim 1, wherein the second section is built with such a shape so that the maximum wastewater accumulation at no-flow condition extends at least approximately 5 meters upstream from the low point of the second section.

5. Vacuum sewerage system according to claim 1, wherein, the first section is built with such a shape so that the maximum volume of wastewater accumulation at no-flow condition is in the range between 5 and 50 liters.

6. Vacuum sewerage system according to claim 1, wherein, the second section is built with such a shape so that the maximum volume of wastewater accumulation at no-flow condition is in the range between 150 and 5000 liters.

7. Vacuum sewerage system according to at claim 1, wherein, the first section extends from the upstream ends of the vacuum sewer so far downstream as wastewater and air is generally transported batchwise from the low point over the high point.

8. Vacuum sewerage system according to claim 1, wherein, the second section extends downstream from the first section towards the vacuum source and is used where wastewater and air is transported substantially continuously at least during peak flow or while an air admission valve is open upstream.

9. Vacuum sewerage system according to claim 1, wherein, the first section is located where the probability that at least one interface valve is open upstream during peak flow is less than 90%.

10. Vacuum sewerage system according to claim 1, wherein, the second section is located where the probability that at least one interface valve is open upstream during peak flow is at least 50% or where an air admission valve is provided upstream, which is opened periodically.

11. Vacuum sewerage system according to claim 1, wherein the first section comprises U-shaped low points, each having legs of different lengths wherein the longer leg connects the low point with the subsequent high point of the first section and the shorter leg extends in the upstream direction.

12. Vacuum sewerage system according to claim 1, wherein, the level difference between a low point and a subsequent high point of the first section is approximately 1 to 5 times the internal diameter of the vacuum sewer in this region.

13. Vacuum sewerage system according to claim 1, wherein, the level difference between a low point and a subsequent high point of the second section is approximately 0.6 to 3 times the internal diameter of the vacuum sewer in this region.

14. Vacuum sewerage system according to claim 1, wherein, the first section is built in level ground in such a way that the vacuum sewer declines downstream from a high point with a downslope of at least 0.2% until the invert level of the vacuum sewer is approximately equal to the crown level of the low point and then further declines with a downslope of at least 3% to the low point and then inclines from the low point to the subsequent high point with an upslope of at least 3%.

15. Vacuum sewerage system according to claim 1, wherein, the second section is built in level ground in such a way that the vacuum sewer declines from a high point with a downslope of at least 0.2% until the low point and then inclines from the low point to the subsequent high point with an upslope of at least 3%.

16. Vacuum sewerage system according to claim 1, wherein, air admission valves are provided at transitions between the first section and the second section for periodically producing flow velocities which are sufficient to whirl up sludge sedimentations.

17. Vacuum sewerage system according to claim 1, wherein, sections of the vacuum sewer including low points and subsequent high points are built of thermoformed plastic pipes.

18. Vacuum sewerage system according to claim 1, wherein air admission valves are provided at enlargements of the vacuum sewer's cross-sectional area for periodically producing flow velocities which are sufficient to whirl up sludge sedimentations.

* * * * *